US007104041B1

(12) United States Patent
Sherman

(10) Patent No.: US 7,104,041 B1
(45) Date of Patent: Sep. 12, 2006

(54) JEWELRY ARTICLE WITH DOUBLE-TIER DIAMOND CUT SURFACE

(75) Inventor: Fred Sherman, New York, NY (US)

(73) Assignee: Royal Chain Inc., New York, NY (US)

( * ) Notice: Subject to any disclaimer, the term of this patent is extended or adjusted under 35 U.S.C. 154(b) by 0 days.

(21) Appl. No.: 11/159,601

(22) Filed: Jun. 23, 2005

(51) Int. Cl.
*B12L 17/00* (2006.01)
*A44C 27/00* (2006.01)

(52) U.S. Cl. ..... 59/35.1; 59/3; 59/80; D11/91; D11/13; 63/4

(58) Field of Classification Search ..... 59/80, 59/82, 3, 35.1; D11/91, 13; 63/4
See application file for complete search history.

(56) References Cited

U.S. PATENT DOCUMENTS 5,535,583 A 7/1996 Holzer et al.
5,581,992 A 12/1996 Borouchov
5,737,910 A 4/1998 Rozenwasser
6,481,196 B1 * 11/2002 Chia et al. ..... 59/80
6,560,955 B1 * 5/2003 Chia et al. ..... 59/80
6,772,580 B1 8/2004 Seliktar
6,786,032 B1 * 9/2004 Chia et al. ..... 59/35.1
6,829,882 B1 * 12/2004 Chia et al. ..... 59/80
6,862,898 B1 3/2005 Seliktar

* cited by examiner

*Primary Examiner*—David B. Jones
(74) *Attorney, Agent, or Firm*—Ostrolenk, Faber, Gerb & Soffen, LLP

(57) ABSTRACT

A jewelry piece made of metal and with a textured surface. The textured surface has: a first series of substantially parallel grooves made by a process of diamond-cutting the surface of the jewelry piece, the grooves having a depth, and a plurality of wells made by a second process of diamond-cutting the surface of the jewelry piece, the wells being deeper than the grooves.

15 Claims, 2 Drawing Sheets

JEWELRY ARTICLE WITH DOUBLE-TIER DIAMOND CUT SURFACE

BACKGROUND OF THE INVENTION

The present invention relates generally to jewelry, and more particularly to jewelry having a diamond cut surface with a texture of greater brilliance, beauty and light reflecting characteristics.

The jewelry business is very competitive. Jewelry designers and manufacturers constantly strive to evolve new and more interesting jewelry designs and are investing a great deal of resources, both monetary and in the form of human resources, in attempts to innovate new designs, new styles, and new, exciting looks in jewelry.

One of the very old and widely used techniques in the creating of textured surfaces on jewelry made from metals, particularly gold, silver and the like, is known as diamond-cutting. The technique of diamond-cutting involves the use of diamond-tipped cutting tools that cut into and texture the metallic surface of the jewelry. Essentially, the purpose of diamond-cutting is to create microfacets in the gold or silver surface which then reflects light in all directions, creating a brilliance, sparkle and a light kaleidoscope that enhances the beauty of the jewelry. Examples of diamond cutting can be found in U.S. Pat. Nos. 5,535,583; 5,581,992; 5,737,910 and 6,772,580.

There is a constant need and desire to build on this old technology, to evolve a more brilliant, more sparkling and more beautiful surface texturing on jewelry.

SUMMARY OF THE INVENTION

Accordingly, it is an object of the present invention to provide an article of jewelry having a more sparkling and more light-reflective surface.

The foregoing and other objects of the invention are realized by the adaptation and improvement of the known diamond-cutting technique to create a double-tier pattern on the surface of the jewelry piece so as to increase the number of light reflecting surfaces to thereby multiply and enhance the brilliance and light-reflecting characteristics of the jewelry surface.

This is accomplished by providing a first diamond cut in the surface of the jewelry piece which resembles a series of substantially parallel ridges and valleys to texture the surface. Subsequently, the surface of the jewelry article is subjected to a second diamond cut which provides a pattern of deeper wells in the textured surface. As stated, these wells are deeper than the valleys created by the first diamond cut. Additionally, the wells do not extend across the entire surface of the jewelry article and are shorter than the ridges and valleys of the first cut.

The deeper wells provided by the second diamond cut produce additional reflective surfaces which increase the brilliance of the jewelry piece.

The deeper wells can be randomly arranged or they can also have a repeating geometric pattern. The distances between the wells and the number of wells can be varied depending upon the size of the jewelry piece and the desired optical characteristics to be achieved.

In a preferred embodiment, the jewelry piece is a necklace or bracelet made up of a plurality of interconnected links wherein each of the links has at least a portion of its surface provided with the double-tier diamond cut surface.

The inventive textured surface can be present on any type of jewelry, including bracelets, necklaces, pendants, or indeed, any piece of jewelry that is made of metal which, when diamond-cut, creates a sparkling affect.

Other features and advantages of the present invention will become apparent from the following description of the invention which refers to the accompanying drawings.

DETAILED DESCRIPTION OF THE INVENTION

Figure 1:
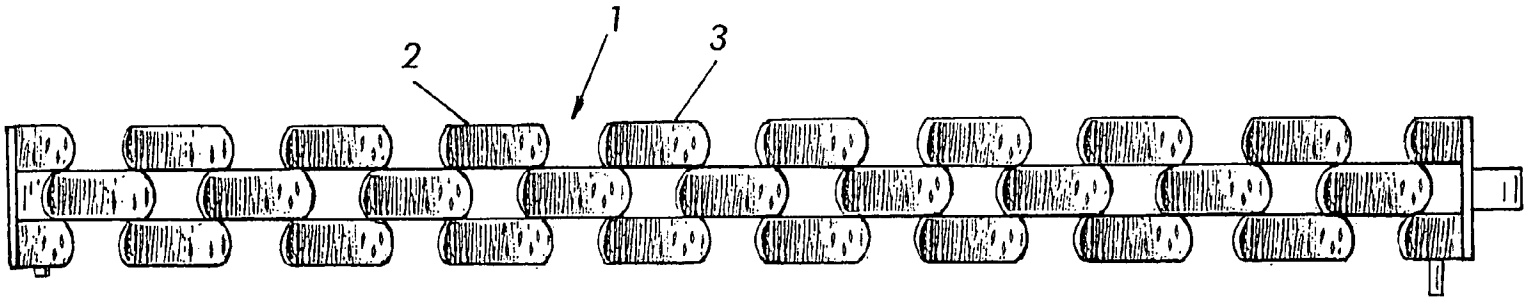
FIG. 1 shows a bracelet which has a textured surface pursuant to the present invention.
Figure 4:
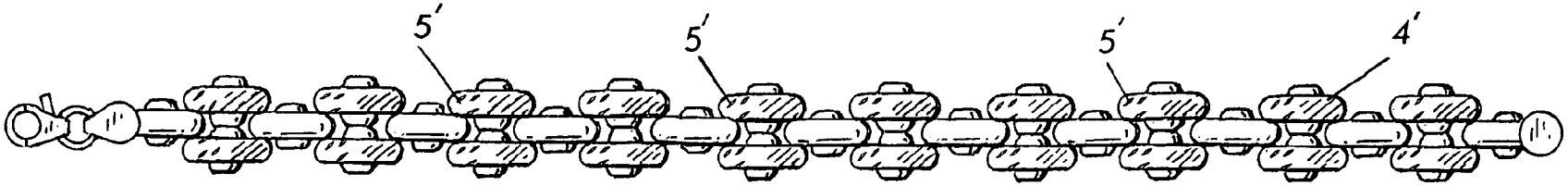
FIG. 4 shows another embodiment of the inventive textured surface on a bracelet.

FIG. 1 shows a bracelet 1 made up of a plurality of interconnected links 2. Each of the links has a textured upper surface 3. This upper surface 3 covers substantially the entire outer surface of the bracelet shown in FIG. 1. However, as shown in FIG. 4, it is not necessary for the texturing to cover the entire outer surface. Furthermore, the texturing of the surface 3 on the bracelet shown in FIG. 1 runs substantially perpendicular to the longitudinal axis of the bracelet. It is understood that the texturing can also be directed in other directions relative to the longitudinal axis of the bracelet. For example, FIG. 4 shows the texturing to be at an angle other than 90° to the longitudinal axis of the bracelet.

The periphery of the links does not need to be shaped as shown in FIG. 1 (or in FIG. 4) and can have any desired shape.

Figure 2:
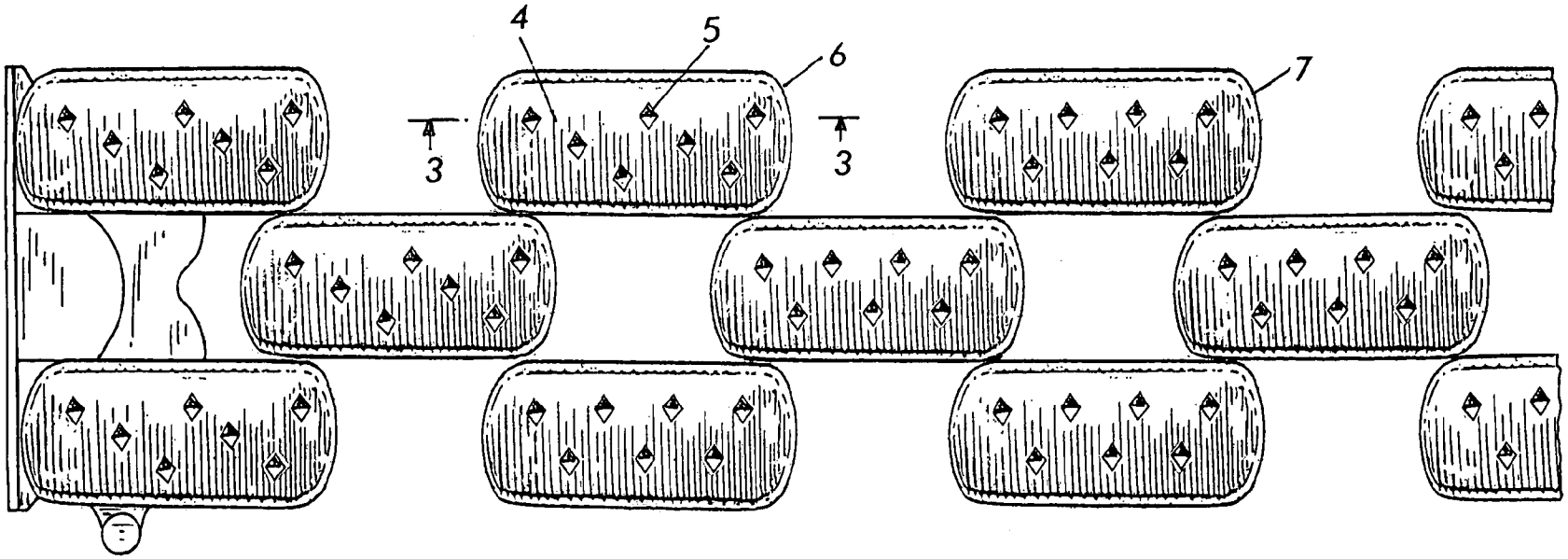
FIG. 2 is an enlarged view showing the details of the surface texture of FIG. 1.
Figure 3:
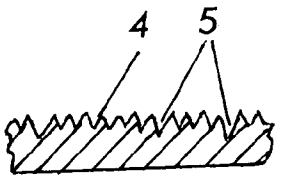
FIG. 3 is a cross-section through lines 3—3 of FIG. 2.

FIG. 2 is an enlarged view of a portion of the bracelet of FIG. 1 in which it is easy to see the textured surface 3 of the links 2. The surface has a first texture 4 formed by a first diamond-cutting operation. The first texture 4 is composed of a plurality of substantially parallel ridges and valleys as seen in FIG. 3. The surface 3 also has a plurality of wells 5 that are deeper than the valleys of the texture 4. These wells 5 are produced by a second diamond cut so that the jewelry piece has a double-tier diamond cut surface.

The size and depth of the wells, as well as their spacing and number can be varied depending upon the surface area of the jewelry article as well as the desired optical characteristics to be obtained. For example, a larger surface area allows more and longer wells than compared to a smaller surface article.

The wells 5 can be completely random in their arrangement as shown for example in the link 6 in FIG. 2, or, the wells can have a predetermined geometric arrangement as shown for example in the link 7 in FIG. 2.

By using a second diamond cut to produce deeper wells in the first diamond cut surface, there results a surface with differing and random axes of reflection whereby light is reflected in a multitude of directions so as to enhance the brilliance of the surface.

FIG. 4 shows another bracelet having the inventive double-tier diamond cut surface. In this embodiment, only some of the links have the double-tier diamond cut surface and in addition to that, only portions of the links are provided with the double-tier diamond cut surface. As can be seen in this embodiment, the texturing 4' of the first diamond cut is diagonal to the longitudinal axis of the bracelet. Furthermore, the wells 5' are also at an angle to the longitudinal axis. Since the link surfaces which are provided with the double-tier diamond cut are smaller than the link surfaces of FIG. 1, the distances between the deeper wells and the number of deeper wells, as well as the length of the wells is different than shown in FIG. 1.

It bears noting that the surface texture according to the present invention can be applied to any jewelry surface made of a material in which the diamond-cutting is made and that such jewelry can be of any surface shape, e.g., flat, curving in two or three-dimensions, as long as the material is thick enough to affect therein the diamond-cutting process. The surface texture can reach and cover the entire surface or only portions thereof, all in accordance with the sensibilities and design preferences of individual customers or jewelry designers and the like.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A jewelry piece made of metal and having a textured surface, the textured surface comprising:

a plurality of substantially parallel grooves made by a process of diamond-cutting a portion of the surface of the jewelry piece, the grooves having a depth; and a plurality of wells made by a second process of diamond-cutting the portion of the surface of the jewelry piece, the wells having a depth deeper than the depth of the grooves.

2. The jewelry piece according to claim 1, wherein the wells are arranged randomly on the surface.

3. The jewelry piece of claim 1, wherein the wells are arranged in a geometric pattern on the surface.

4. The jewelry piece according to claim 1, wherein the plurality of grooves are substantially parallel to each other, and the wells extend in a common direction with the grooves.

5. The jewelry piece according to claim 1, wherein the grooves and the wells each include a length, the length of the wells is shorter than the length of the grooves.

6. The jewelry piece according to claim 1, wherein the portion of the surface that has the grooves and wells covers a part of the surface.

7. The jewelry piece according to claim 1, wherein the entire surface of the jewelry piece is covered by the grooves and wells.

8. A jewelry piece comprising:

a plurality of interconnected links, each of the links having an outer surface with a surface area, the surface area comprising a plurality of substantially parallel grooves made by a process of diamond-cutting the surface of the links, the grooves having a depth; and a plurality of wells made by a second process of diamond-cutting the surface of the links, the wells having a depth deeper than the depth of the grooves.

9. The jewelry piece according to claim 8, wherein the links extend along a longitudinal axis, the grooves and wells extending substantially perpendicular to the longitudinal axis.

10. The jewelry piece according to claim 8, wherein the links extend along a longitudinal axis, the grooves and wells being inclined relative to the longitudinal axis.

11. The jewelry piece according to claim 8, wherein the jewelry piece is a bracelet.

12. The jewelry piece according to claim 8, wherein the jewelry piece is a necklace.

13. A method for texturing a surface of a jewelry piece made of metal to increase light reflectivity, the method comprising the steps of:

forming a plurality of grooves in a portion of the surface of the jewelry piece by a first diamond-cutting process, wherein the grooves are substantially parallel to each other and have a depth and a length; and forming a plurality of wells in the portion the surface by a second diamond-cutting process, wherein the wells have a depth and a length, respectively deeper and shorter than the depth and the length the grooves.

14. The method according to claim 13, wherein the step of producing wells in the surface positions the wells randomly in the surface.

15. The process according to claim 13, wherein the step of producing the wells positions the wells in a geometric pattern in the surface.

* * * * *